US006112828A

United States Patent [19]

Leal

[11] Patent Number: 6,112,828

[45] Date of Patent: Sep. 5, 2000

[54] EARTH WORKING SCRAPER

[76] Inventor: Servando Leal, 1101 Jennifer, Pampa, Tex. 79065

[21] Appl. No.: 09/054,779

[22] Filed: Apr. 3, 1998

Related U.S. Application Data

[60] Provisional application No. 60/043,057, Apr. 4, 1997.

[51] Int. Cl.[7] ..... A01B 15/00

[52] U.S. Cl. ..... 172/684.5; 172/799.5; 37/436; 37/415

[58] Field of Search ..... 172/684.5, 311, 172/737, 815, 445.1, 669, 799.5; 37/416, 901, 431, 435, 398, 436, 444, 445, 411, 415, 421, 427

[56] References Cited

U.S. PATENT DOCUMENTS

| | | | |
|---|---|---|---|
| 2,262,283 | 11/1941 | Henry et al. | 37/412 X |
| 2,319,486 | 5/1943 | Austin | 37/411 X |
| 2,329,210 | 9/1943 | McGee | 37/411 X |
| 2,562,193 | 7/1951 | Johnson | 37/412 X |
| 2,567,534 | 9/1951 | Whittier | 37/412 X |
| 4,308,677 | 1/1982 | Behm | 37/416 |
| 4,630,686 | 12/1986 | Ausmus, Jr. | 172/684.5 X |
| 5,794,714 | 8/1998 | Brown | 172/684.5 X |
| 5,839,212 | 11/1998 | Brinker | 172/684.5 X |

*Primary Examiner*—Victor Batson

*Attorney, Agent, or Firm*—Royston, Rayzor, Vickery, Novak & Druce, L.L.P.

[57] ABSTRACT

An earth working scraper including a semi-circular scraper assembly having a scraper blade and a plurality of wall sections. The wall sections form a compartmentalized space substantially interior the scraper assembly for carrying soil. A wheeled carriage is journalled to the scraper assembly with a plurality of support arms and is adapted to partially support the scraper assembly. An arched connector is fixedly attached to the scraper assembly and removably attachable to a towing vehicle, the arched connector being adapted to partially support the scraper assembly. At least one hydraulic cylinder is included in the combination which is journalled between the wheeled carriage and the scraper assembly. The hydraulic cylinder assembly is adapted to cooperate with the arched connector to raise and lower the scraper assembly and also to rotate the scraper assembly about a transverse axis therethrough.

4 Claims, 3 Drawing Sheets

EARTH WORKING SCRAPER

RELATED PATENT APPLICATIONS

This patent application claims priority to U.S. Provisional Application Ser. No. 60/043,057 filed Apr. 4, 1997 entitled EARTH WORKING SCRAPER.

FIELD OF THE INVENTION

This invention relates generally to earth working equipment. More specifically, the invention pertains to scraping devices used in the arrangement of construction materials by scraping and/or spreading the same for the purpose of smoothing a ground surface.

BACKGROUND OF THE INVENTION

In the construction industry, the need for manipulating soil and other bases for construction are encountered. This can occur in the construction of buildings, paved roads and other improvements. Earth moving and preparing equipment may also be used in the construction of such structures as earthen tanks and retaining walls intended to contain among other things water, chemicals and petroleum products. Oftentimes, the soil to be prepared is in a packed condition that is difficult to loosen or scrape in a preparation process. Therefore, mechanical scrapers of different designs have been developed for these purposes. A common scraper used in road construction is mounted or hitched upon a large grader-type piece of equipment. This type of scraper is normally mounted midship upon the carrying grader. A second popular configuration is either a direct mount or a hitch mount scraper blade behind a towing tractor. In the case of both such configurations, the scraper blade is normally canted to one side so that scraped soil is directed across the blade and dispensed therefrom at the trailing side edge of the blade. These scrapers will not normally have capabilities for containing the soil and transporting it to another location. Still further, the mounting mechanisms between the blades and carrying equipment are usually not configured to take advantage of the natural effects of the downward digging forces experienced on such equipment during scraping activities. Therefore, in view of these needs and potential benefits to be enjoyed in these areas, the present invention has been designed and developed.

SUMMARY OF THE INVENTION

The scraping apparatus of the present invention enjoys several benefits over presently available devices and methods for earth grading; the same being attributable to, among other aspects, the design of the scraper blade and the configuration of the carrying mount by which the blade is towably hitched to a powering vehicle. The nature of the blade's construction permits the same to be inexpensively manufactured by utilizing sections of metal pipe as a primary component of the scraper blade. Because of the semi-circle nature of the scraper that results, a tub type component is established having an interior volume that accepts and has the capability for carrying soil. Further, wall-type extensions are provided forward of the blade and alongside the semi-circular portion so that a greater interior volume is established for accepting and moving soil during a scraping process. In order to enhance the operable life of the scraper, a durable blade is provided at the lower scraping surface of the semi-circular tubular portion that extends slightly below grade or the lower portion of the side walls for digging into the soil and elevating the same into the device's interior space.

The mounting for the scraper blade is also unique in that it provides an arch over the blade so that forwardly directed forces can be applied substantially horizontally to the blade apparatus during forward travel. Still further, this suspension system allows the operator to take advantage of the natural downward digging effect of the scraper blade that is angularly directed at the soil. By permitting capitalization on this effect, it is not necessary for extreme downward forces to be applied on the scraping structure. Instead, the scraper is permitted to operate under its natural effects without undue pressures being exerted thereon.

The position of the blade during operation is advantageously controlled by hydraulic cylinders remotely operable from the powering vehicle. By operating the piston and cylinder system, the blade can be properly positioned for the desired degree of scrape effect. Still further, the raising and lowering action of the blade can be used at times to apply a downward scraping effect and collection of soil and it may also be used for raising the blade to an elevated position above the underlying soil surface so that soil is dispensed therefrom and spread beneath the blade thereby achieving a fill-in effect, as well smoothing the dispensed soil.

The blade is journalled to the wheeled carriage below the cylinders for stabilization during operation and providing a locking mechanism when the blade is raised to an uppermost travel position during which scraping in not desired, and in fact must be avoided. An example would be when the scraper apparatus is moved from one construction site to another along a roadway. At these travel times, it is imperative that the blade not be lowered or downwardly disposed thereby causing damage to itself and potentially to the pavement over which travel is occurring.

From the benefits described hereinabove regarding both the construction and use of the present invention, it is obvious that commercial applications and uses will be plentiful in both construction industries, as well as others in which soil preparation is required.

DESCRIPTION OF THE DRAWINGS AND ILLUSTRATIVE PHOTOGRAPHS

DESCRIPTION OF THE INVENTION

Figure 1:
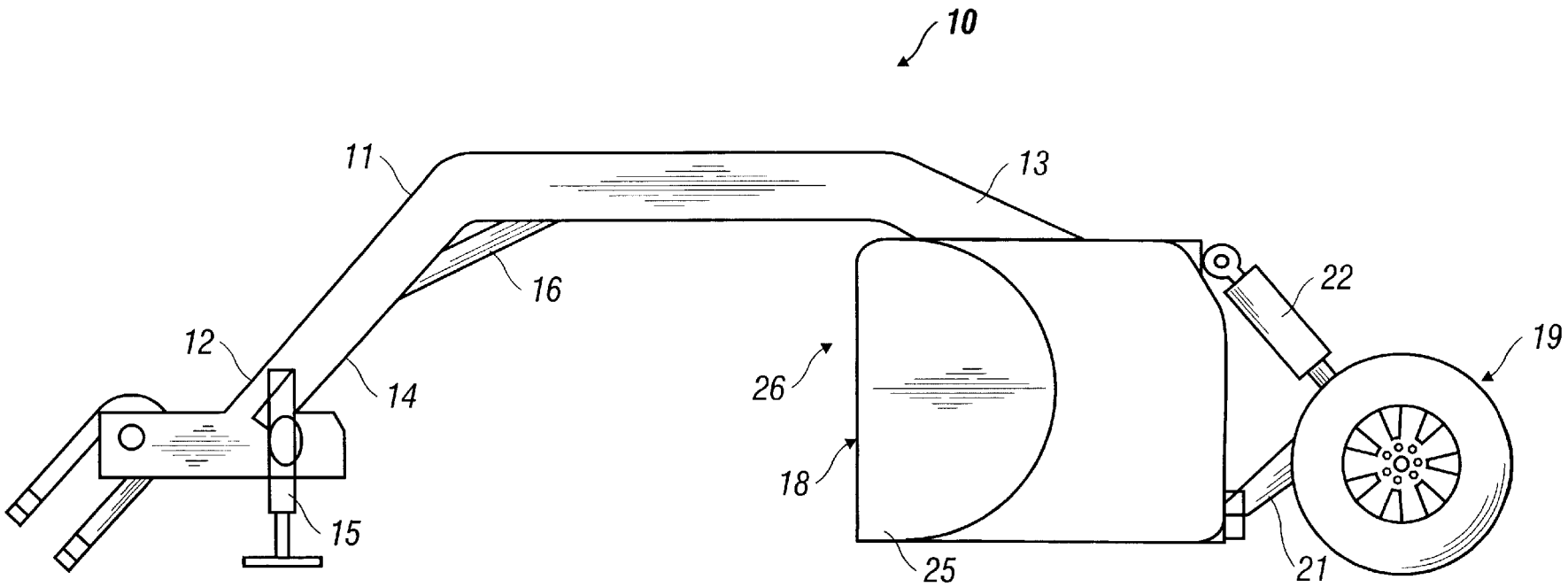
FIG. 1 is a side elevational view of the working scraper.
Figure 2:
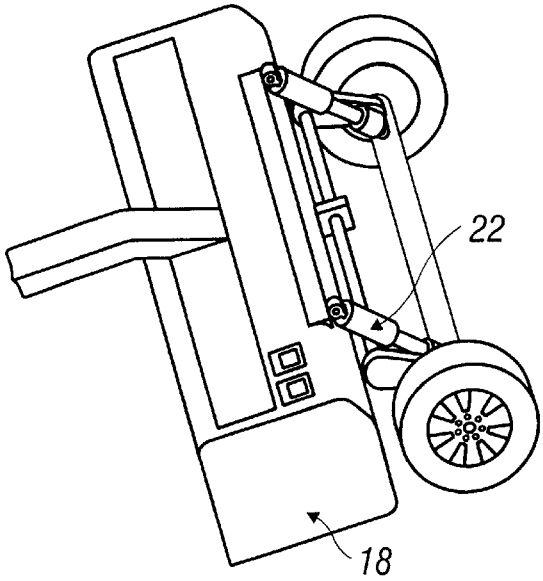
FIG. 2 is an elevated side perspective view of the scraper.
Figure 3:
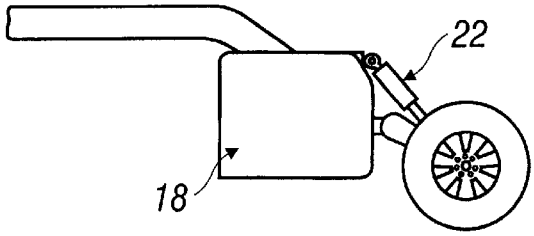
FIG. 3 is a side elevational view of the scraper.

The earth working scraper 10 of the present invention is illustrated in the drawing and several photographs described above and included herewith as part of this disclosure. As may be appreciated in FIG. 1, the apparatus includes several primary components. Each is connected together and works in cooperation to provide the scraper that traverses across the ground on a wheeled carriage 11 that is connectable to a towing vehicle. Though not shown, such a vehicle will normally be a tractor being adequately equipped for traversing both paved and unimproved ground surfaces. This type is familiar in the construction industries and is readily available at most building sites where it is desirable to employ such a scraping device.

Referring again to FIG. 1, it may be appreciated that a goose neck-type arched connector 12 is fastened to the blade structure itself at a rearward 13 end and is adapted at a forward 14 end for connection to the towing vehicle. Also at the forward end is an elevationally adjustable jack 15 that is used for establishing the height of the connective end. As in conventional designs, this jack may terminate in a base foot or a rotable wheel. The angled portions of the goose neck arch may be optionally braced 16 for increased strength. It is expected and illustrated in the preferred embodiment that the arch connector 12 will be constructed from tubular steel of sufficient strength to withstand the applied and resulting forces experienced during use. As may be best appreciated in FIG. 5, the arched hitching component terminates rearwardly at a three post 17 connection, each of which post 17 is welded directly to the blade assembly 18.

Figure 4:
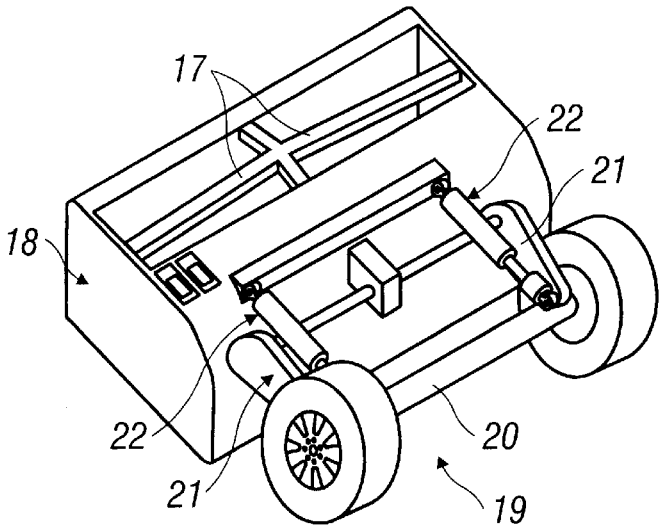
FIG. 4 is a rear perspective view from the side of the scraper.

Referring to FIG. 4, the wheeled carriage 19 upon which the blade assembly is carried is illustrated. Two wheels are distally located one from the other on a rotable axle 20 to which the blade assembly 18 is journalled upon two arms 21. Each arm 21 facilitates pivotal rotation at each end so that the blade assembly 18 can be raised and lowered relative to the ground surface upon which the tires are traversing. The raising and lowering of the blade assembly 18 is accomplished by the cylinder and piston combination 22 that is hydraulically driven between extensions and contractions. As shown in FIG. 4, the lower arms 21 together with the cylinder configuration establish a parallelogram that permits the blade to be raised and lowered in a vertical plane when desired but also may be used to rotate the blade 23 about a horizontal axis when the angle of attack of the blade 23 is desired to be adjusted.

Figure 5:
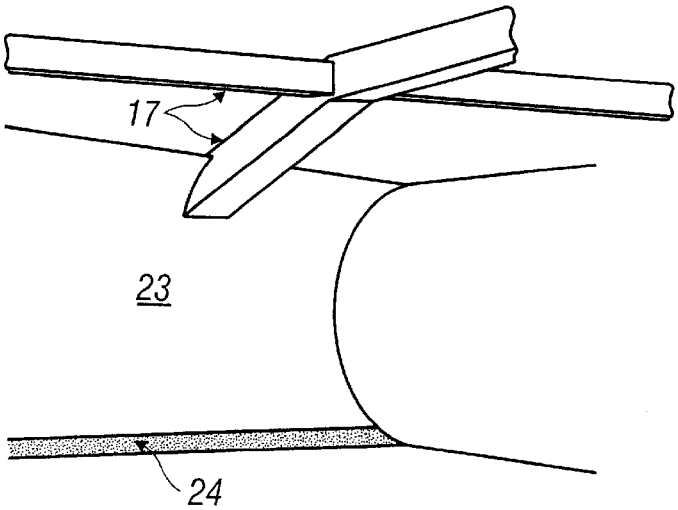
FIG. 5 is an interior perspective view of the scraper blade and hitch mount connection thereto.
Figure 6:
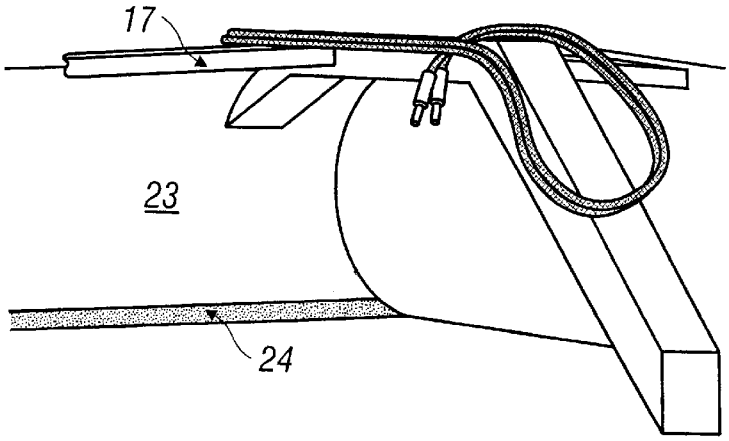
FIG. 6 is a perspective view of the front side of the blade with the hydraulic connections shown upon the arched connector.
Figure 7:
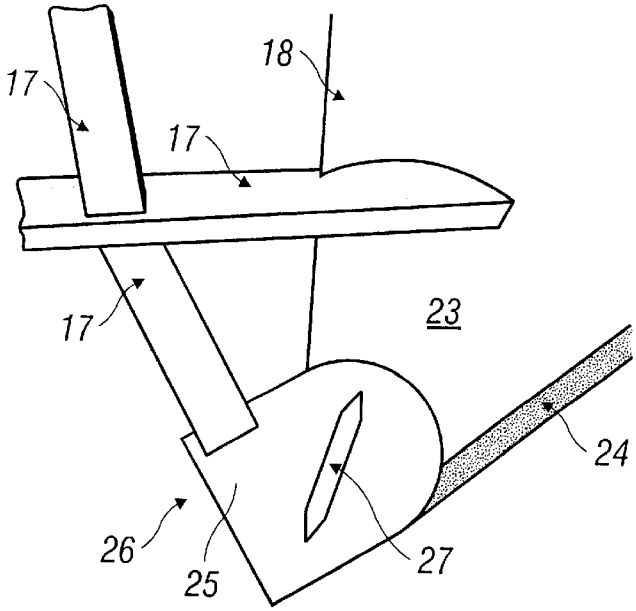
FIG. 7 is a close-up perspective view looking upward at the interior of the blade surface.

As may be best appreciated in FIGS. 5 through 7, the blade 23 of the scraper may be advantageously constructed from metal pipe having a substantially circular cross-sectional shape. The pipe is cut so that the arched blade 23 is established from a section from the cut pipe. To that pipe section, a wear resistant cutting or scraping blade 24 is attached for increased performance and longevity of use. Walls 25 are provided at each end of the semi-circular blade structure that establish an interior portion of the blade assembly creating a compartment 26 for accepting soil scraped from the ground over which it is carried.

The cutting blade 24 surface extends slightly below the lower portion of the walls 25 so that the walls 25 may ride essentially at ground level with the blade extending therebelow. In this manner, the blade assembly 18 tends to dig into the soil as a result of the angle of attack that the blade 23 is directed at the soil being traversed. Also, by having the wall portion 25 ride at ground level, the interior compartment 26 is established between the ground's surface and the bladed structure 18 that includes those side walls 25. As may be appreciated in FIG. 7, the three-piece hitch mount 17 at the blade structure 18 is connected with a center post directly to the semi-circular blade portion 23 and two lateral posts connected to the wall portions 25.

Framing members are provided about the blade structure for support and fortitude during use. As previously described, the blade 23 of the illustrated scraper may be positioned at various heights for both scraping and digging out soil as well as spreading and dispensing soil from a raised position. By providing the interior containing area 26 within the blade assembly 18, soil may be collected and transported to various locations which may include spreading and smoothing to level ground surfaces. As may also be appreciated in FIG. 7, an interior angled ridge 27 is provided on the interior surface of the blade's wall 25.

The journalled arm system upon which the blade structure is connected to the carriage is lockable so that any given orientation of the blade may be fixed relative to the carriage. This provides a safety feature that locks the apparatus into a travel configuration when the device is to be moved from one site to another. As described hereinabove, this assures that the blade 23 does not engage the ground when not intended to do so.

Based on the description and illustrations provided herein, the many benefits provided by the invented structure are apparent. These described benefits, as well as those that are inherent to those skilled in the art, fall within the scope of the invention of the present patent application as limited only by the claims appended hereto.

I claim:

1. An earth working scraper, comprising:

a scraping apparatus including a scraper blade having opposing wall sections connected thereto to form a compartment for accepting earth substantially within said scraping apparatus;

a wheeled carriage journalled to said scraping apparatus with a plurality of support arms, said wheeled carriage being adapted to provide occasional support for said scraping apparatus;

an arched connector having a first end fixedly attached to said scraping apparatus and at least a portion of said first end of said arched connector directly attached to said scraper blade, said arched connector further comprising a hitch end releasably attachable to a towing vehicle;

at least one hydraulic piston and cylinder combination journalled between said wheeled carriage and said scraper blade, said at least one hydraulic piston and cylinder combination being adapted to raise and lower said scraper blade relative to the earth that is worked by said scraping apparatus and said at least one hydraulic piston and cylinder combination having an end portion directly connected to said scraper blade.

2. An earth working scraper as recited in claim 1 wherein said opposing wall sections ride in contact with the ground as earth accumulates within said compartment.

3. An earth working scraper as recited in claim 1 wherein said first end of said arched connector includes a plurality of posts welded to said scraping apparatus with at least one of said posts welded directly to said scraper blade.

4. An earth working scraper as recited in claim 1 wherein said at least one hydraulic piston and cylinder combination has an extended configuration and a contracted configuration, said extended configuration used to raise said scraping apparatus above ground level to spread earth from within said compartment, while said contracted configuration sets said scraper blade into the ground for earth working.

* * * * *